US005107171A

United States Patent [19]

Gerritsen

[11] Patent Number: 5,107,171

[45] Date of Patent: Apr. 21, 1992

[54] CATHODE RAY TUBE INCLUDING MEANS FOR VERTICALLY EXTENDING THE SPOT

[75] Inventor: Jan Gerritsen, Eindhoven, Netherlands

[73] Assignee: U.S. Philips Corporation, New York, N.Y.

[21] Appl. No.: 560,468

[22] Filed: Jul. 25, 1990

Related U.S. Application Data

[63] Continuation of Ser. No. 333,751, Apr. 3, 1989, abandoned, which is a continuation of Ser. No. 848,538, Apr. 7, 1986, abandoned.

[30] Foreign Application Priority Data

Feb. 5, 1986 [NL] Netherlands ..... 8600463

[51] Int. Cl.[5] ..... H01J 29/70

[52] U.S. Cl. ..... 313/421; 313/426; 313/443

[58] Field of Search ..... 313/421, 426, 431–433, 313/442, 443

[56] References Cited

U.S. PATENT DOCUMENTS

| | | | |
|---|---|---|---|
| 3,023,336 | 2/1962 | Frenkel | 313/433 |
| 3,881,136 | 4/1975 | Scheele | 313/453 |
| 4,377,767 | 3/1983 | Kornaker | 313/409 X |
| 4,424,466 | 1/1984 | Zepperfeld | 313/437 X |
| 4,468,587 | 8/1984 | Sluyterman | 313/442 |

*Primary Examiner*—Donald J. Yusko
*Assistant Examiner*—Michael Horabik
*Attorney, Agent, or Firm*—Robert J. Kraus

[57] ABSTRACT

A cathode ray tube, such as a blue luminescing projection television display tube including, in an evacuated envelope (1), an electron gun (5) for generating an electron beam (6) which is focused to a spot (8) on a display screen (7) by means of an electrostatic focusing lens (27, 30) and which is deflected across this display screen (7) in two mutually perpendicular directions (x, y). A structure (37) magnetized as a four-pole and consisting of a magnetic half-hard material is provided at the area of a focusing lens formed by two electrodes (27, 30) and coaxially around the gun axis (20), the axes of the four-pole being located centrally between the deflection directions. The structure (37) extends the spot in the vertical direction so that phosphor saturation, particularly in blue projection tubes is reduced.

6 Claims, 1 Drawing Sheet

CATHODE RAY TUBE INCLUDING MEANS FOR VERTICALLY EXTENDING THE SPOT

This is a continuation of application Ser. No. 333,751, filed Apr. 3, 1989, now abandoned which is a continuation of application Ser. No. 848,538, filed Apr. 7, 1986', now abandoned.

BACKGROUND OF THE INVENTION

The invention relates to a cathode ray tube comprising in an evacuated envelope an electron gun for directing an electron beam to a display screen. The electron gun comprises an electrostatic focusing lens, the electron beam being deflected during operation across said display screen in two mutually perpendicular directions, namely a line scan direction and a field scan direction.

A cathode ray tube of this type may be a projection television display tube or a different type of display tube in which only one electron beam is generated.

Phosphor saturation is a problem in projection tubes, particularly for the zinc sulfide phosphor used for blue. It is therefore desirable to provide a cathode ray tube with means to reduce the phosphor saturation.

SUMMARY OF THE INVENTION

It is known that the human eye is less sensitive to the definition of the blue partial image than that for that of the green and red partial images because blue has a very low luminance contribution and because the eye has less resolving power for blue. The invention utilizes this face by enlarging the spot in a (blue luminescing) projection tube, thus reducing the current density and hence the phosphor saturation. Particularly, the dimension of the (blue) spot in the vertical direction (the direction transverse to the line scan direction) is enlarged.

The conventional blue phosphor has a very short persistence period (some tens of microseconds). A vertical spot enlargement then results in the phosphor being excited with a reduced current density for a number of times with intervals of 64 μs by overlapping of picture liens. As this interval is of the same order or is longer than the persistence period, less phosphor saturation will occur. On the other hand, a horizontal spot enlargement would only lead to a distribution of the current load over several hundred nanoseconds (much shorter than the persistence period) and thus would not continue to a reduction of the saturation, fur uselessly sacrifice definition.

It is therefore favourable to give the (blue) spot a vertically extended shape, which can e achieved by causing an electric or magnetic quadripolar field to act on the beam. This can be realized in various manners.

A simple and elegant embodiment is possible fi a permanent magnetic structure on the gun is sued in a (blue luminescing) projection tube. In this structure (which preferably has the shape of a ring) a fixed four-pole component can be induced to achieve the above-described object. The advantage is that no extra components or defeating constructions are required and that otherwise the gun designs for red, green and blue luminescing tubes may be identical.

A preferred embodiment of the cathode ray tube according to the invention is therefore characterized in that the means for extending the electron beam comprise a permanent magnetized structure of a magnetic half-hard metyarial in which a four-pole is induced whose axes are located centrally between the line scan direction and the field scan direction.

A further preferred embodiment of a display tube according to the invention is characterized in that the focusing lens, viewed in the direction of propagation of the electron beam, consists of a first and a second cylindrical focusing lens electrode, which first electrode e tends coaxially in the second electrode and in that the permanent magnetized structure is secured to the end of the second electrode remote from the first electrode. By securing the structure after the lens gap of this accelerating focusing lens, the desired distortion of the electron beam can be effected in a very effective manner. In fact, the distorted beam does not subsequently pass any longer through an electron lens where it could be distorted again. In addition, it is easy in practice to secure, for example, a ring to the end of a cylindrical electrode. The structure or ring may of course also be provided in the second focusing lens electrode at the area of the edge of the first focusing lens electrode. It is also possible to provide the structure or ring just in front of the focusing lens, for example, at the end of the second focusing lens electrode facing the cathode. However, the distorted beam than still passes through the focusing lens.

BRIEF DESCRIPTION OF THE DRAWING

The invention will now be described in greater detail by ay of example with reference to the drawing in which.

DESCRIPTION OF THE PREFERRED EMBODIMENT

Figure 1:
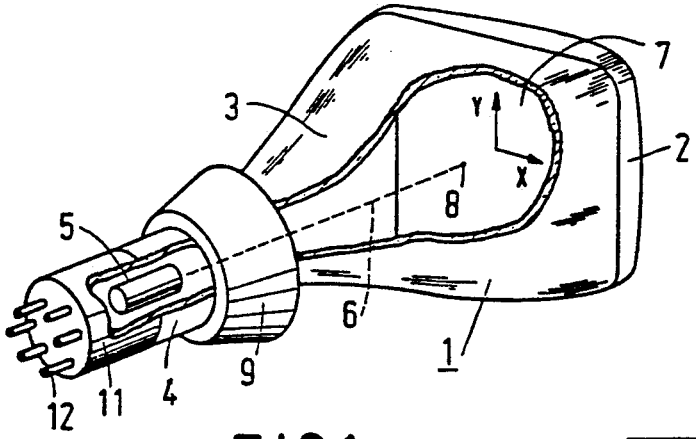
FIG. 1 is a perspective elevational view, patly broken away up, of a display tube according to the invention.

FIG. 1 is a perspective elevational view, partly broken away, of a display tube according of the invention. this tube comprises a glass envelope 1 consisting of a display window 2, a cone 3 and a neck 4, which neck accommodates an electron gun 5 for generating an electron beam 6. this electron beam 6 is focused to a spot 8 on a display screen 7. The display screen 7 is provided on the inner side of the display window 2. The electron beam is deflected across the display screen 7 in two mutually perpendicular directions x, y by using the deflection coil system 9. The tube has a base 11 with connection pins 12.

Figure 2:
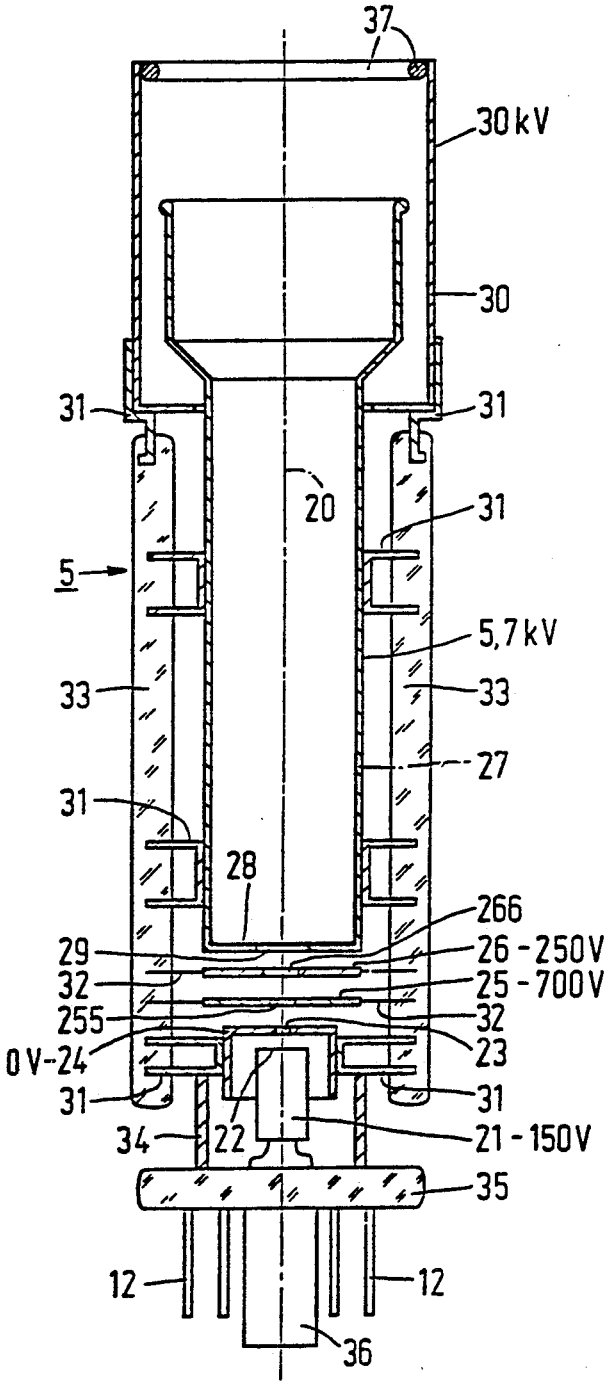
FIG. 2 is a longitudinal sectional view of an electron gun for a display tube according to FIG. 1.

FIG. 2 is a longitudinal section of an electron gun 5 according to FIG. 1. This electron gun comprises a cathode 21 centered along an axis 20, which cathode has an emitting surface 22, a control electrode 24 having an aperture 23, a first anode 25 having an aperture 255, a prefocusing electrode 26 having an apertured 266, a first cylindrical focusing lens electrode 27 having a bottom 28 with an aperture 29, and a second cylindrical focusing lens electrode 30. The electrodes 24, 25, 26, 27 and 30 are secured to glass rods 33 by means of brackets 31 and pins 32 which are sealed in the rods. The entire electron gun assembly is secured to a glass bottom plate 35 by means of the pins 34, which plate is provided with an exhaust tube 36 and connection pins 12. The connection wires between the various gun electrodes and the connection pins have been omitted so as not to make the drawing needlessly complicated.

Figure 3:
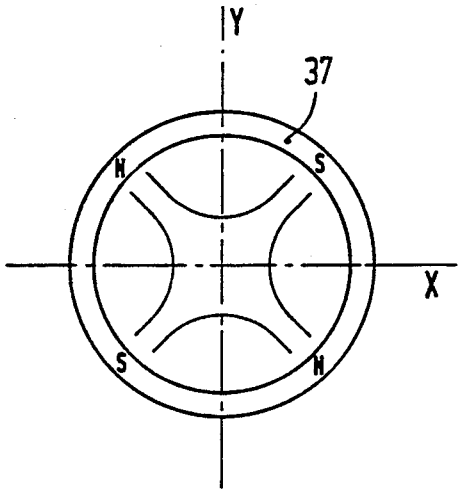
FIG. 3 is a diagram and illustrating production of a quadrupole field b a magnetic ring.

A ring 37 of a magnetic half-hard material as described in German Patent No. 23,612,607 (corresponding to U.S. Pat. application Ser. No. 057,708 filed Jun. 1, 1987), is provided at the end of the second focusing electrode 30. This material consists of, for example, an alloy of Fe, Co, V and Cr which alloy is known under the tradename of Koerflex (a trademark of Messrs, Drupp). No welding operation may be performed on this ring, because otherwise the magnetic properties change. Therefore the ring is secured with a number of clamps not shown. The gun assembly shown in FIG. 2 is inserted into the neck 4 of the tube (see FIG. 1), positioned, and then sealed to the glass plate 35. Subsequently a four-pole is externally induced in the ring 37 after the tube is finished, with the axes of the four-pole being located centrally between the line scan direction (x) and the field scan direction (y). See FIG. 3. A four-pole is provided in the ring 37, for example, in a manner and by means of a magnetizing device as described in U.S.. Pat. No. 4,220,897.

It stands to reason that magnetizable structure is not limited to bring and may alternatively have a different shape. Thus it is possible to place a number of magnetizable elements in a ring of a non-magnetic material and subsequently mount them to the gun. The focusing lens may alternatively be a unipotential lens or a "multistage" lens.

What is claimed is:

1. A monochromatic cathode ray tube including an envelope containing a screen comprising a luminescent material, an electron gun for producing an electron beam for exciting a luminescing spot on the screen, and deflection means for deflecting the electron beam in a first direction across the screen and in a second direction transverse to the first direction to effect production, on the screen, of mutually-adjacent luminescing lines, characterized in that:

a. the luminescent material saturates at a predetermined current density, has a substantial persistence period, and luminesces in a color for which the human eye has a lower resolving power than for certain other colors; and b. the electron gun comprises as is field-producing means for focusing the electron beam into said spot on the screen, and a second field-producing mans for widening the spot in a direction transverse to the luminescing lines produced thereby sufficiently to overlap at least an adjacent one of said luminescing liens, thereby deceasing the beam current density below said predetermined current density and effecting repeated excitation, during production of a luminescing lien, of said at least one adjacent luminescing line.

2. A monochromatic cathode ray tube as in claim 1 where the second field-producing means comprises a permanently magnetized structure of a magnetic half-hard material for producing a four-pole magnetic field through which the electron beam passes.

3. A monochromatic cathode ray tube as in claim 2 where the first field-producing means comprises, in a direction of propagation of the electron beam, first and second cylindrical focusing lens electrodes, said first electrode extending coaxially into the second electrode, and said permanently magnetized structure being secured to an end of the second electrode which is remote from the first electrode.

4. A monochromatic cathode ray tube as in claim 2 or 3 where the permanently magnetized structure has an annular shape.

5. A monochromatic cathode ray tube as in claim 1 wherein the luminescent material has a persistence period which is of the same order as an internal during which one of said luminescing lines is produced on the screen.

6. A monochromatic cathode ray tube as in claim 1 wherein the luminescent material has a persistence period which is shorter than an interval during which one of said luminescing lines is produced on the screen.

* * * * *